US011045681B2

(12) United States Patent
Gineris et al.

(10) Patent No.: US 11,045,681 B2
(45) Date of Patent: Jun. 29, 2021

(54) WEIGHTED SOCK

(71) Applicant: Loren Gineris, St. Charles, IL (US)

(72) Inventors: Loren Gineris, St. Charles, IL (US); Pam Rancour, St. Charles, IL (US); Ruben Aburto, Winfeild, IL (US)

( * ) Notice: Subject to any disclaimer, the term of this patent is extended or adjusted under 35 U.S.C. 154(b) by 143 days.

(21) Appl. No.: 15/894,226

(22) Filed: Feb. 12, 2018

(65) Prior Publication Data

US 2019/0247699 A1 Aug. 15, 2019

(51) Int. Cl.
*A63B 21/065* (2006.01)
*A41B 11/00* (2006.01)
*A63B 23/04* (2006.01)

(52) U.S. Cl.
CPC ..... *A63B 21/065* (2013.01); *A41B 11/00* (2013.01); *A63B 23/0405* (2013.01); *A41B 2300/20* (2013.01); *A41B 2300/35* (2013.01); *A41B 2400/32* (2013.01); *A63B 2209/00* (2013.01); *A63B 2225/096* (2013.01)

(58) Field of Classification Search
CPC ..... A63B 21/065; A63B 23/0405; A63B 2209/00; A63B 2225/096; A41B 2400/32; A41B 2300/35; A41B 2300/20; A41B 11/00–146
See application file for complete search history.

(56) References Cited

U.S. PATENT DOCUMENTS 1,729,209 A * 9/1929 Curtice ..... A63B 21/065 482/105
3,278,184 A * 10/1966 Rosenbaum ..... A63B 21/065 482/105
3,306,610 A 2/1967 Biggs, Jr. et al.
3,334,898 A * 8/1967 McCrory ..... A63B 21/065 482/105
3,369,258 A * 2/1968 Smith ..... A63B 71/146 2/159
3,406,968 A * 10/1968 Mason ..... A43B 19/005 482/105
3,490,766 A * 1/1970 Gardner ..... A63B 21/0607 482/105
3,490,768 A * 1/1970 Archer ..... A63B 21/065 473/213
4,005,494 A * 2/1977 Burn ..... D04B 1/26 2/239

(Continued)

FOREIGN PATENT DOCUMENTS

CH 67205 A5 10/1989

OTHER PUBLICATIONS

Google Search, Website discussing concept of Weighted Socks; 3 pages, No other Information Available.

*Primary Examiner* — Garrett K Atkinson
(74) *Attorney, Agent, or Firm* — James Conte; Conte Law Group

(57) ABSTRACT

A weighted sock has a weight assembly at a portion of the sock. The weight assembly has a weight carrier. The weight carrier has a carrier space with a weight therein. The weight is configurable to take on a first shape by a force which also changes the shape or dimension of the weight carrier. The weight carrier, when having the changed shape or dimension, has a force of sufficient magnitude to reconfigure the weight into a second shape different from the first shape when the force which also changes the shape or dimension of the carrier is removed.

20 Claims, 5 Drawing Sheets

(56) References Cited

U.S. PATENT DOCUMENTS 4,247,097 A * 1/1981 Schwartz ..... A63B 21/065 2/158
4,364,564 A * 12/1982 Lewis ..... A63B 69/38 473/213
4,445,233 A * 5/1984 Rubin ..... A41B 11/006 2/239
4,556,215 A * 12/1985 Tarbox ..... A63B 21/065 2/161.1
4,575,075 A * 3/1986 Tarbox ..... A63B 21/065 2/161.1
4,756,525 A * 7/1988 Whitsitt ..... A63B 21/065 482/105
4,911,433 A * 3/1990 Walker ..... A63B 21/065 2/161.1
4,961,235 A * 10/1990 Williger ..... A41B 11/006 2/239
5,027,440 A 7/1991 Morris et al.
5,127,891 A * 7/1992 Winston ..... A63B 21/065 482/105
5,480,376 A * 1/1996 Duback ..... A41D 13/015 602/8
5,514,056 A * 5/1996 Ronca ..... A63B 21/0607 482/105
5,555,562 A * 9/1996 Holt ..... A41D 13/0015 2/69
5,683,335 A 11/1997 Groves et al.
5,784,716 A * 7/1998 Holt ..... A63B 21/065 2/69
5,802,615 A * 9/1998 Wenk ..... A63B 71/146 2/160
5,836,019 A * 11/1998 McCafferty ..... A41B 11/006 2/239
5,978,964 A * 11/1999 Gaston ..... A63B 21/065 2/228
6,005,041 A * 12/1999 Cook ..... A63B 21/06 524/435
6,168,556 B1 * 1/2001 Saavedra ..... A63B 21/4019 224/220
6,199,216 B1 * 3/2001 Weatherspoon ..... A41B 11/006 2/239
6,213,920 B1 * 4/2001 Ronca ..... A63B 21/0607 482/105
6,275,997 B1 * 8/2001 Richardson ..... A41B 11/005 2/239
6,354,114 B1 * 3/2002 Sghiatti ..... A41B 11/00 2/239
6,401,256 B1 * 6/2002 Shreve ..... A63B 21/0605 2/239
6,554,752 B2 * 4/2003 Cook ..... A63B 21/065 482/105
6,561,958 B2 * 5/2003 Pappert ..... A63B 21/06 482/105
7,090,624 B1 * 8/2006 Chrishon ..... A63B 21/0601 482/105
7,100,216 B2 * 9/2006 Matechen ..... A41D 13/0156 2/455
8,215,773 B2 * 7/2012 Gibson-Horn ..... A61F 5/026 351/203
8,876,667 B2 * 11/2014 Russotti ..... A63B 21/0607 482/44
9,364,029 B2 * 6/2016 Patel ..... A41B 11/006
10,369,400 B2 * 8/2019 Pozo
2005/0081277 A1 * 4/2005 Matechen ..... A41D 13/0518 2/102
2005/0107728 A1 * 5/2005 Vetters ..... A41B 11/008 602/23
2006/0172870 A1 * 8/2006 Virji ..... A63B 21/065 482/105
2008/0244801 A1 * 10/2008 Russo ..... A63B 71/081 2/22
2010/0031706 A1 * 2/2010 Chaveau ..... A61F 13/069 66/178 R
2010/0050322 A1 * 3/2010 Zagula ..... A41B 11/006 2/239
2010/0311551 A1 * 12/2010 Winston ..... A63B 21/0605 482/105
2011/0000006 A1 * 1/2011 Fehring ..... A41B 11/02 2/240
2011/0016610 A1 * 1/2011 Wieder ..... A41D 20/00 2/170
2011/0043755 A1 * 2/2011 Gibson-Horn ..... A61F 5/026 351/203
2011/0247127 A1 * 10/2011 Pou ..... A41D 13/0012 2/227
2011/0277218 A1 * 11/2011 Padilla ..... A41B 11/02 2/239
2012/0102613 A1 * 5/2012 Loth ..... A41D 13/0543 2/22
2012/0117706 A1 * 5/2012 Tateo ..... A41D 13/065 2/24
2013/0281262 A1 * 10/2013 Russotti ..... A63B 21/0607 482/44
2014/0007329 A1 * 1/2014 Dosio ..... A41D 13/06 2/455
2014/0059742 A1 * 3/2014 Patel ..... A41B 11/006 2/239
2014/0090273 A1 * 4/2014 Piontkowski ..... A43B 23/17 36/44
2016/0374412 A1 * 12/2016 Cubeddu ..... A41B 11/08 2/22
2017/0106225 A1 * 4/2017 Bores Cifo ..... A63B 21/16
2018/0110274 A1 * 4/2018 LaRue ..... A41D 13/065
2018/0185171 A1 * 7/2018 Sifuentes Lumbreras ..... A41B 11/00
2019/0022450 A1 * 1/2019 Martinoli Sanz .... A63B 21/065
2019/0059454 A1 * 2/2019 Bellissimo ..... A63B 71/1225
2019/0059455 A1 * 2/2019 Vaughn ..... A41B 11/006
2019/0184263 A1 * 6/2019 Porte ..... A41D 13/0543

* cited by examiner

WEIGHTED SOCK

FIELD

The present disclosure concerns a sock having pluralities of weight assemblies at a leg of the sock. Each weight assembly measured along a circumferential direction about the leg of the sock, extends for more than 0.25 and less than 0.5 of the circumference of the leg of the sock. Preferably each weight assembly extends 0.33 of the circumference of the sock. Each weight assembly has a plurality of weight carriers and a plurality of weights. Each weight carrier of an assembly carries a weight of the assembly.

BACKGROUND

Increased neuromuscular feedback, increased proprioception of bilateral lower extremities and increased tactile feedback are phenomenal therapy tools for the client needing sensory integration strategies included in their treatment plan. Adding increased weight to bilateral lower extremities assists the central nervous system in knowing where the individual foot is in space (proprioception) as well as improving the clients tactile input. Increased weight on bilateral lower extremities assists individuals with neuromuscular-skeletal injuries to walk with improved neuromuscular feedback, improved alignment, and improved coordination.

U.S. Pat. No. 6,401,256, Orthopedic Sock System, Lee P. Shreve, discloses an orthopedic sock system including a pair of identical sock structures and a number of weight inserts. Each identical sock structure includes a sock portion having a foot receiving cavity in connection with a tubular leg receiving portion and a number of weight insert receiving pouches formed in connection with the sock structure. A number of weight insert receiving pouches are provided in connection with a foot top cover portion of each sock structure, a number of weight insert receiving pouches are provided in connection with an interior ankle surface covering outer portion of each sock structure, a number of weight insert receiving pouches are provided in connection with an exterior ankle surface covering outer portion of each sock structure, a number of weight insert receiving pouches are provided in connection with an above the interior ankle surface covering outer portion of each sock structure, and a number of weight insert receiving pouches are provided in connection with an above the exterior ankle surface covering outer portion of each sock structure. Each weight receiving pouch is optionally provided with a hook and pile fastener mechanism for securing a respective weight insert within the weight receiving pouch. The weight inserts are positioned within user selected weight receiving pouches to allow a user to have increased resistance at locations on the user's foot, ankle, and/or lower shin such that the user receives a rehabilitative benefit.

U.S. Pat. No. 7,090,624, Exercise System, Marcellus D. Chrishon, discloses an exercise system for allowing a user to increase endurance, power, speed, quickness, and overall body conditioning. The exercise system includes a body member that is adapted to snuggly fit around a portion of a user. A plurality of pockets is coupled to the body member. Each of the pockets has a flap that is secured to a front panel of each the pockets such that the flap is for closing each of the respective pockets. A plurality of weight members each are selectively insertable into each of the pockets such that the weight members are adapted to change the weight resistance against the muscles of the user when the body member is fitted around a portion of a user. The body member has a leg opening and a heel opening and a toe opening. The body member is adapted to receive a foot of a user to position the body member over an ankle. At least one of the pockets is positioned above the ankle of a user.

U.S. Pat. No. 5,027,440, John A. Morris, discloses various weight loss systems and methods and weighted distal limb sleeves for promoting non-exercise activity thermogenesis (NEAT). One embodiment is an anatomically-weighted distal limb sleeve for use in a weight loss program. One such anatomically-weighted distal limb sleeve is adapted and sized to be comfortably worn on a distal portion of a person's limb relative to a limb joint. The anatomically-weighted distal limb sleeve comprises a predefined amount of exogenous weight arranged on the limb sleeve to simulate the anatomical distribution of endogenous soft tissue of the distal portion of the limb.

SUMMARY

Some known ankle weights used to address increasing neuromuscular feedback, increasing proprioception of bilateral lower extremities, and increasing tactile feedback add bulk around the ankle joint and this bulk decreases the ability of the weight to work correctly for this population, as it disturbs the normal gait cycle. The result is an abducted gait pattern with increased circumduction during the swing phase of the gait cycle. Some products on the market place weight pouches on client's shoe laces. This places weight in an unnatural position and interferes in the normal gait cycle. Still other products place weights in pouches on the lateral side of the leg. This provides an unnatural placement of weight, disturbing the gait cycle.

The weighted sock of the present disclosure provides for improved sensory integration of legs. The sock's streamlined design, light total weight, and specific placement of the weights ensures the sock will not disturb the normal gait pattern of a child or adult. It may be worn for multiple hours at a time comfortably by children or adults of any age. The socks are completely machine washable and dryable allowing many years of use. The metal in the socks is non-toxic and rust proof. The socks slip on and off, just like regular socks.

The weighted sock is also useful in strengthening the user's bilateral lower extremity musculature.

Accordingly, an example of the invention comprises a weighted sock. The weighted sock has an open end and a closed end. A weight assembly of the weighted sock is at a portion of the sock. The weight assembly has a weight carrier. The weight carrier has a carrier space. A weight is in the carrier space. The weight is configurable to take on a first shape or dimension by a force which also changes the shape or dimension of the weight carrier. The carrier when having the changed shape or dimension provides a force of sufficient magnitude to reconfigure the weight into a second shape or dimension different from the first shape when the force which also changes the shape or dimension of the carrier is removed.

Figure 1:
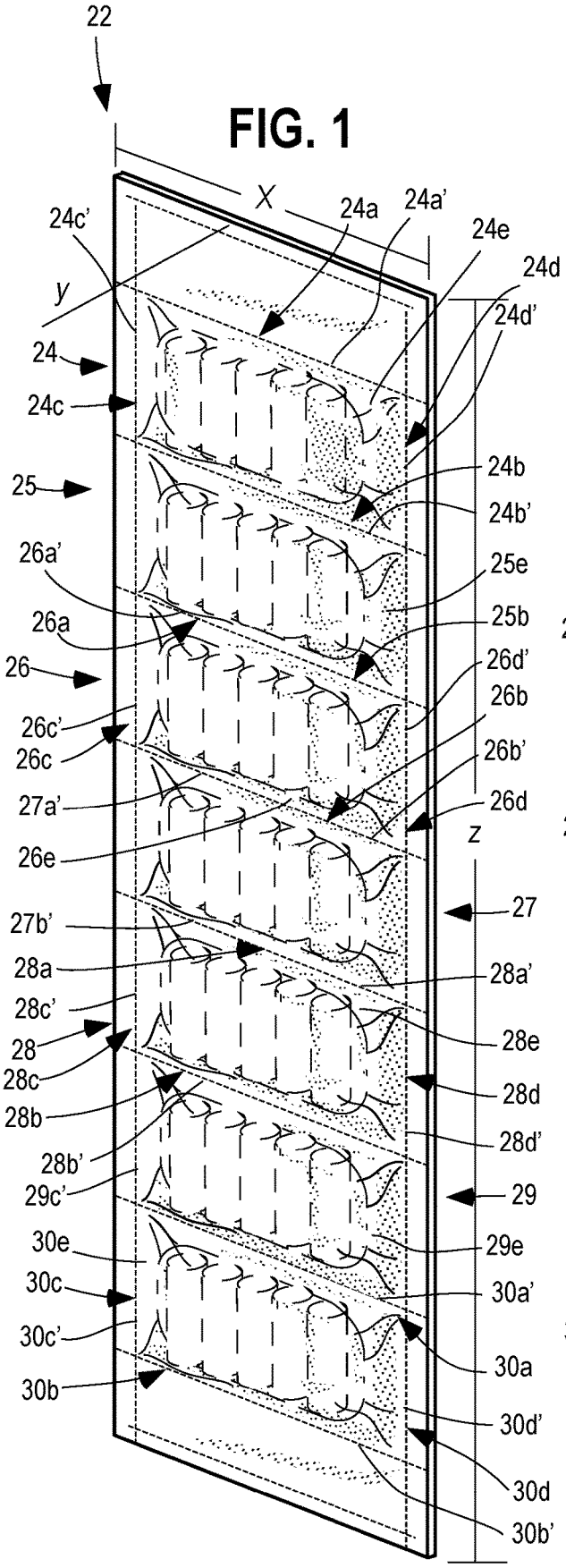
FIG. 1 is a first sided isometric view of a weight assembly of the present invention; the view is corresponded with an XYZ coordinate template.
Figure 2:
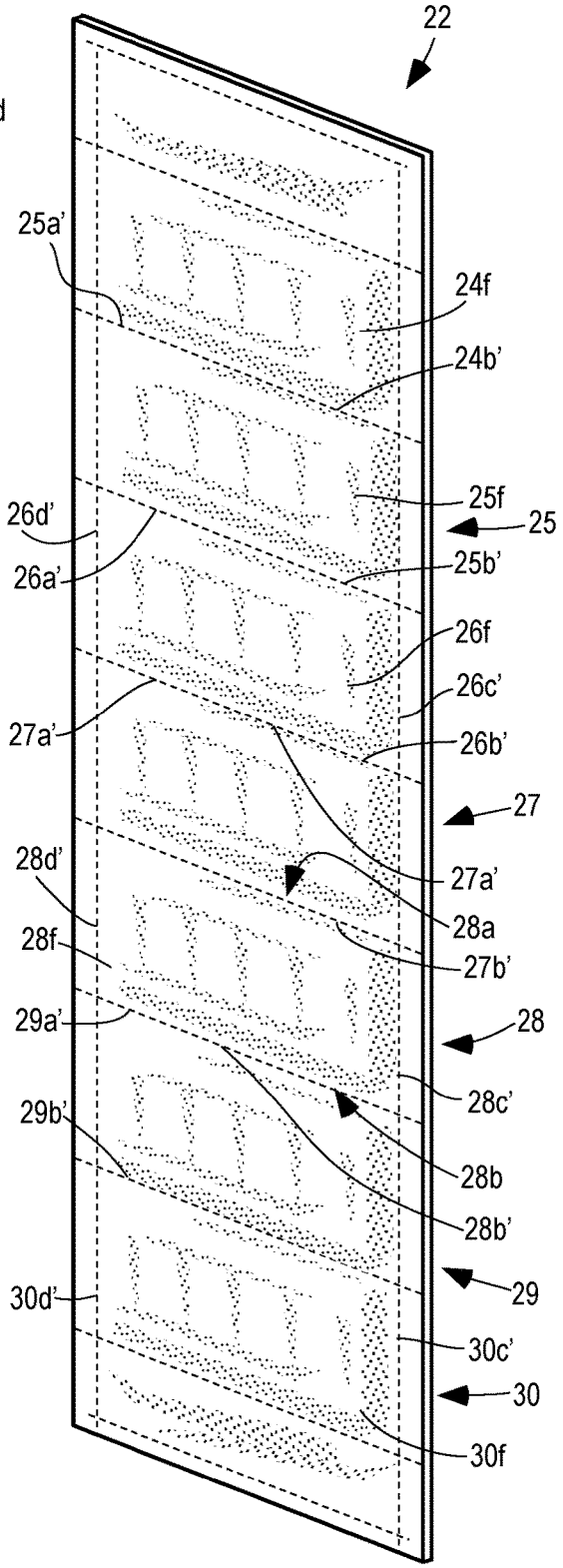
FIG. 2 is a second sided isometric view of the weight assembly of FIG. 1; the second sided view is opposite the first sided view.
Figure 3:
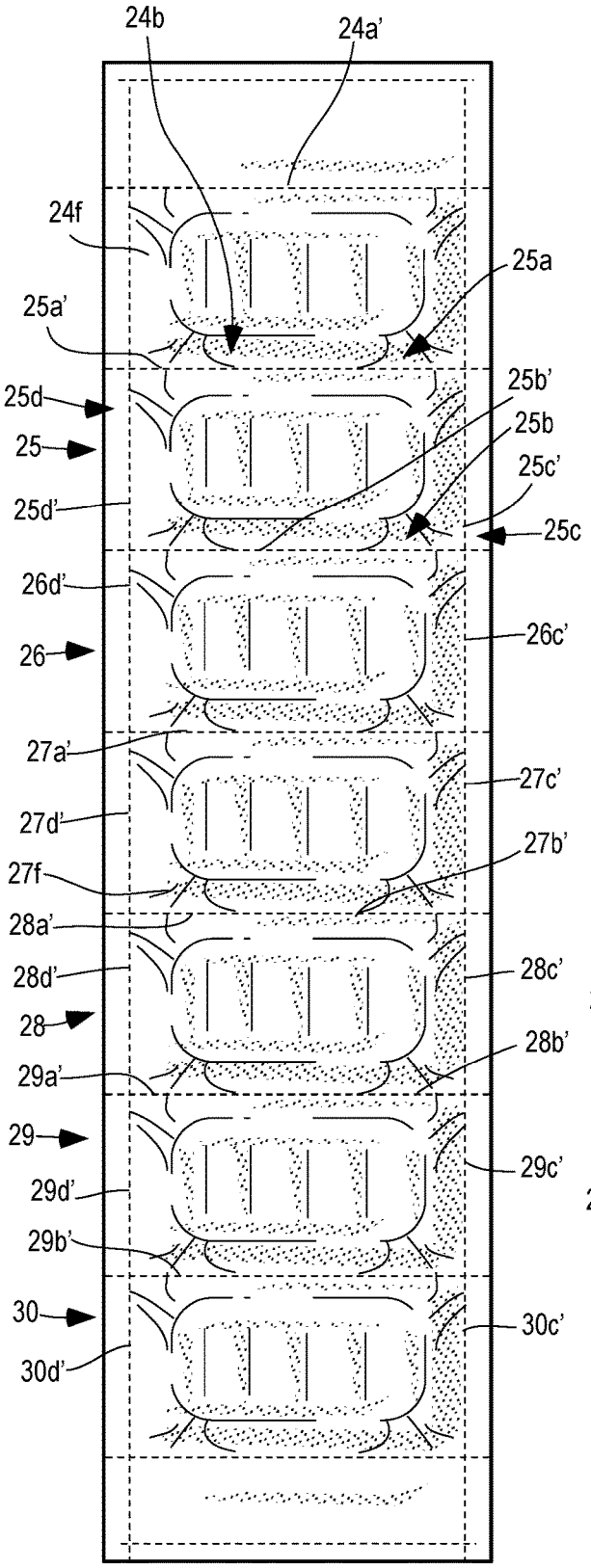
FIG. 3 is a second sided facing view of the weight assembly of FIG. 2.
Figure 4:
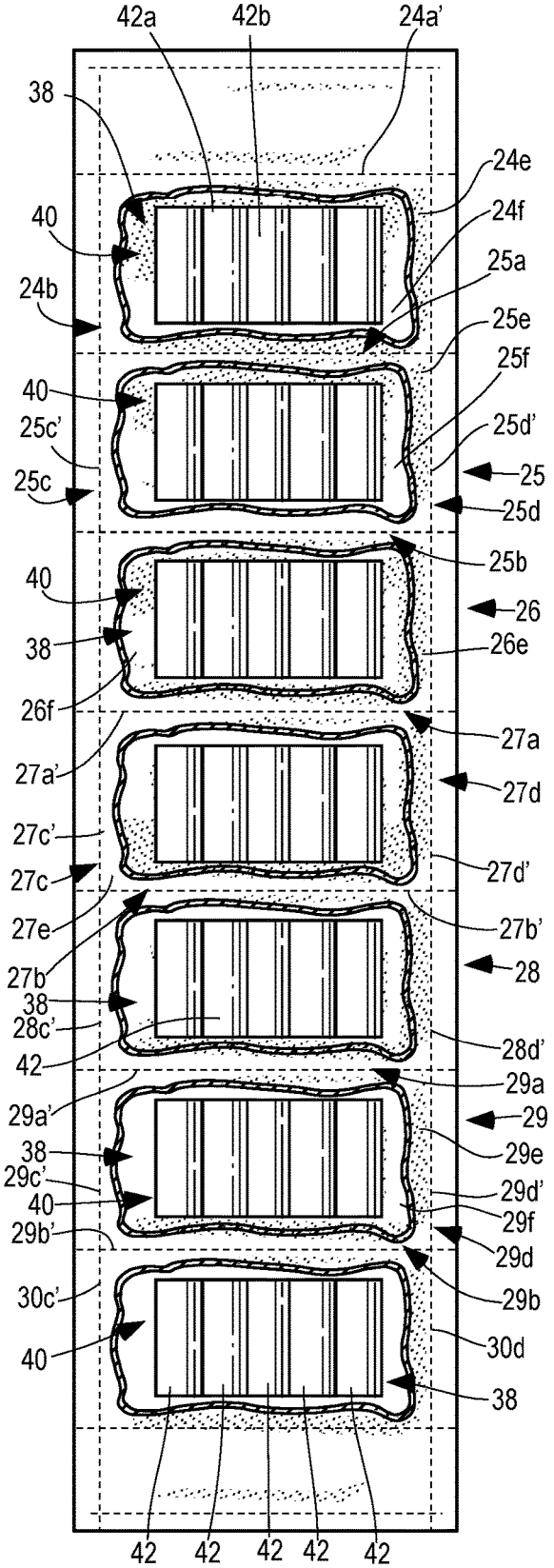
FIG. 4 is a first sided facing view of the weight assembly of FIG. 1 wherein portions of the first portions of material of weight carriers is cutaway to reveal weights comprising individual mass units.
Figure 5:
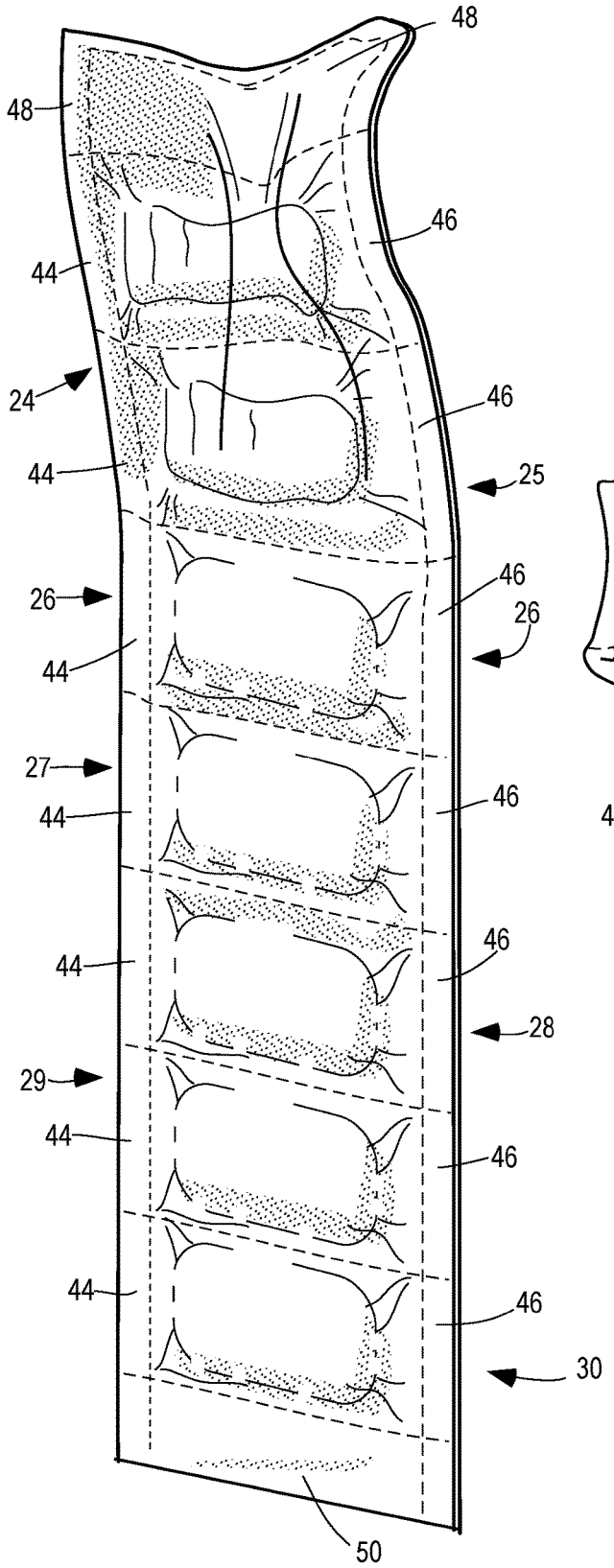
FIG. 5 is a first sided view of the weight assembly of FIG. 1 wherein the first end weight carrier and first interior weight carrier and the weights therein are deformed into a first shape curving about an axis extending in the Z direction.
Figure 6:
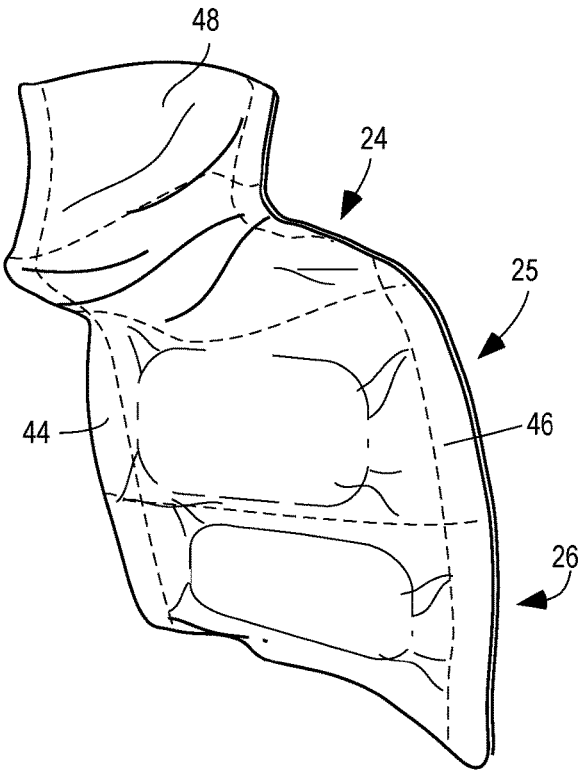
FIG. 6 is a partial first sided view of the weight assembly of FIG. 1 wherein the first end weight carrier and the weight therein are deformed into a first shape twisting about an axis extending in the X direction.
Figure 7:
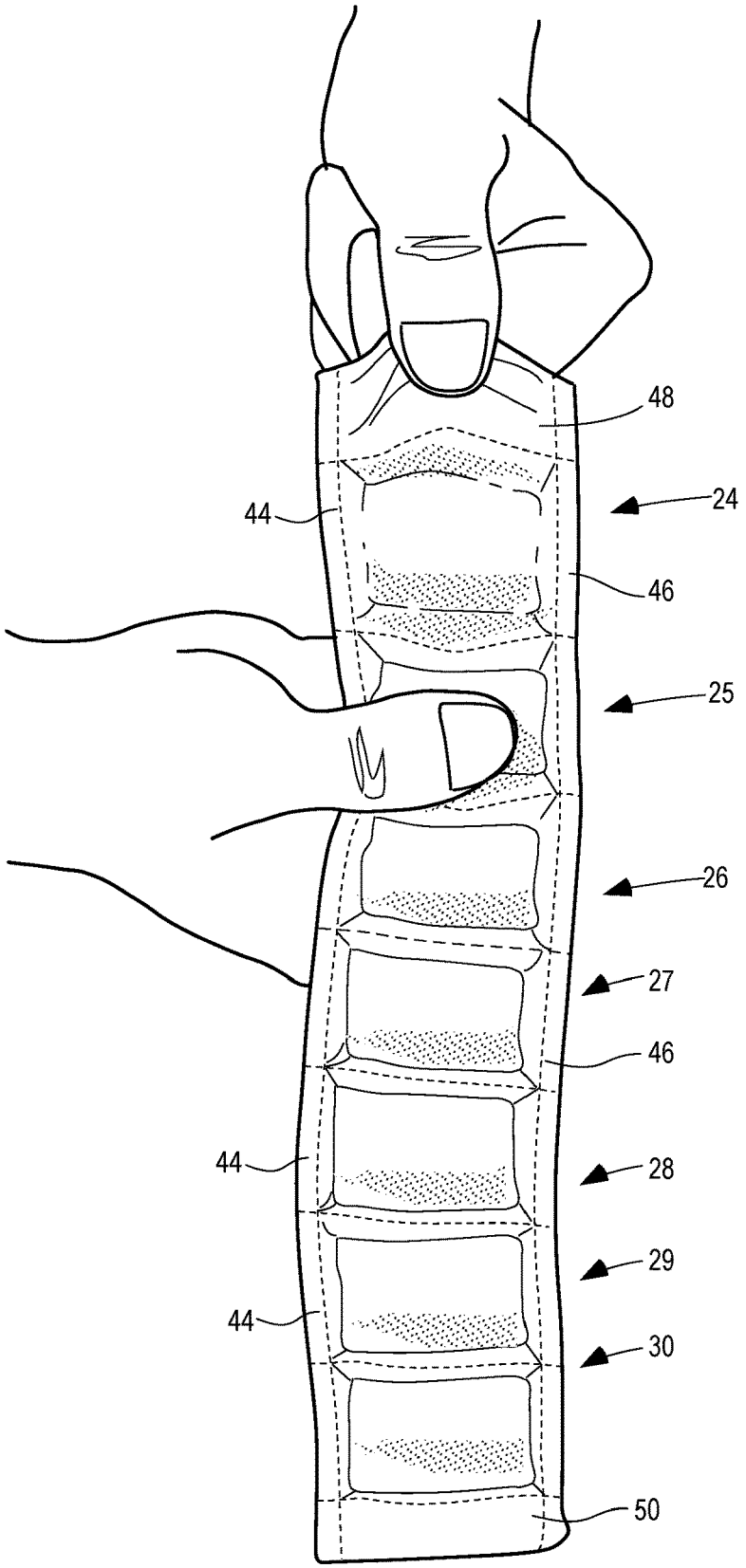
FIG. 7 is a first sided view of the weight assembly of FIG. 1 wherein the first end weight carrier and the weight therein are deformed into a first shape stretching in the Z direction.
Figure 8:
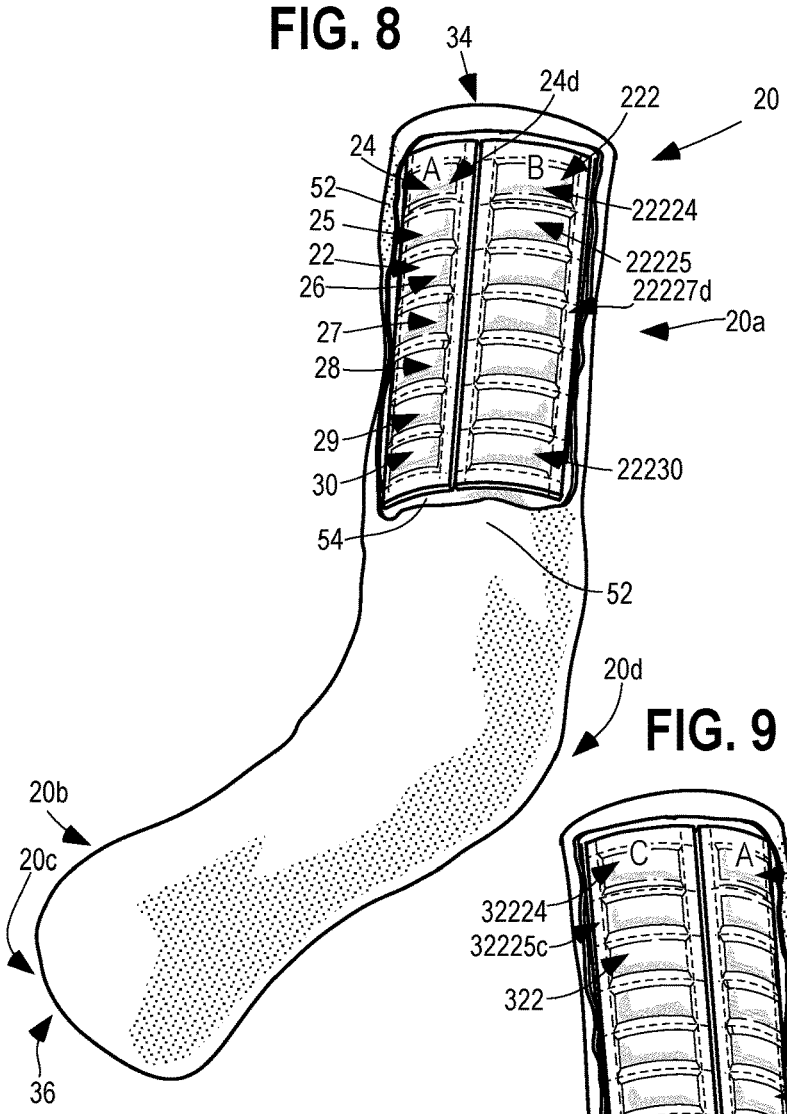
FIG. 8 is a cut away view of a weighted sock showing the weight assembly of FIG. 1, labeled as A, and an additional weight assembly labeled as B, both at the leg portion of the sock.
Figure 9:
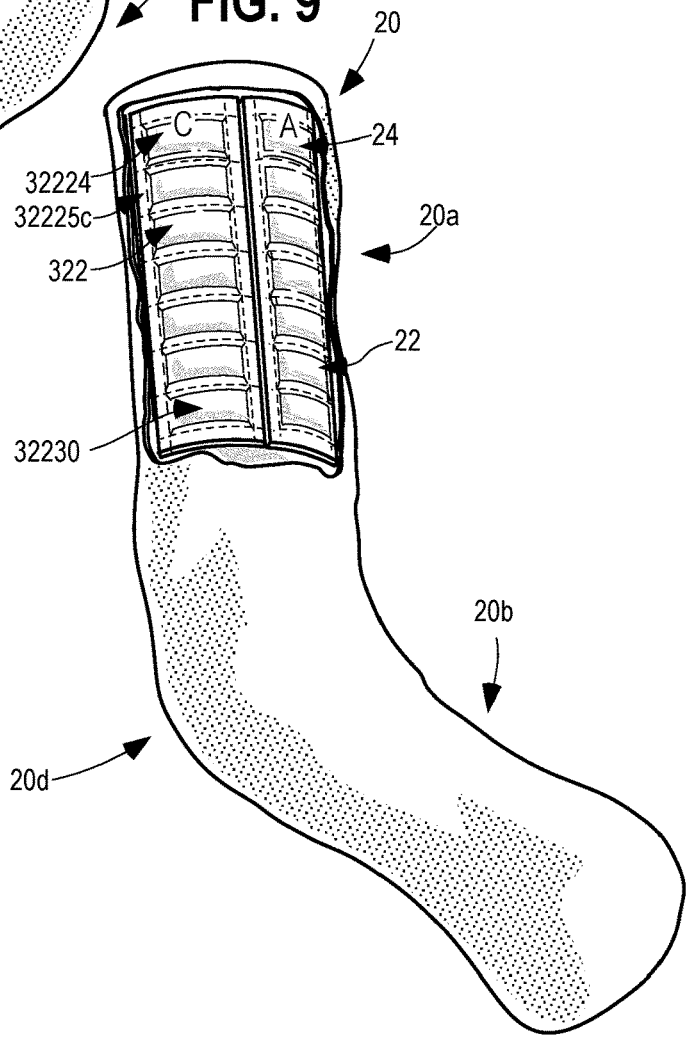
FIG. 9 is a cut away view of the weighted sock of FIG. 8 showing the weight assembly of FIG. 1, labeled as A, and an additional weight assembly labeled as C, both at the leg portion of the sock.

Before any embodiments of the invention are explained in detail, it is to be understood that the invention is not limited in its application to the details of construction and arrangement of components set forth in the following description or as illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

The weighted sock 20 has a plurality of weight assemblies 22, 222, 322. A weight assembly 22 of the plurality of weight assemblies 22, 222, 322 has a plurality of permanently closed weight carriers 24, 25, 26, 27, 28, 29, 30. The phrase "permanently closed" means the structure is designed to remain closed and not opened by an end user during normal use of the sock. A weight carrier 24 of the permanently closed weight carriers of the weight assembly is a first end closed weight carrier 24 and another of the permanently closed weight carriers is a second end closed weight carrier 30. The first end closed carrier 24 is permanently closed at a first end 24*a*. A seam 24*a*' closes the weight carrier at the first end 24*a*. The seam is a place where a first portion of material 24*e* of the weight carrier is permanently joined to a second portion of material 24*f* of the weight carrier by stitches. The weight carrier 24 is permanently closed at a second end 24*b*. A seam 24*b*' closes the weight carrier 24 at the second end 24*b*. The seam is a place where the first portion of material 24*e* of the weight carrier is permanently joined to the second portion of material 24*f* of the weight carrier by stitches. The weight carrier 24 is permanently closed at a third end 24*c*. A seam 24*c*' closes the weight carrier at the third end 24*c*. The seam is a place where the first portion of material 24*e* is joined to the second portion of material 24*f* by stitches. The weight carrier 24 is permanently closed at a fourth end 24*d*. A seam 24*d*' closes the carrier at the fourth end 24*d*. The seam is a place where the first portion of material 24*e* is joined to the second portion of material 24*f* by stitches.

The first end closed weight carrier 24 is adjacent and coupled to a first interior closed weight carrier 25. The first end closed weight carrier 24 is adjacent the first interior closed weight carrier 25 along first end carrier's second end 24*b* and the first interior carrier's first end 25*a*. The first end closed weight carrier second end 24*b* is common with the first interior weight carrier's first end 25*a*. The stitches and seam 24*b*' making up the second end 24*b* of the first end closed carrier 24 are the stitches and seam 25*a*' making up the first end 25*a* of the first interior permanently closed weight carrier 25. The first end 24*a* of the first end weight carrier 24 is not adjacent a weight carrier. It is the end of the weight carrier closest to an open end 34 of the sock. The first interior permanently closed weight carrier 25 second end 25*b* is common with the first end 26*a* of the second interior permanently closed weight carrier 26. The first interior closed weight carrier 25 is coupled to the second interior closed weight carrier 26. The same stitches and seam 25*b*', 26*a*' make up the first end 26*a* of the second interior weight carrier 26 and the second end 25*b* of the first interior weight carrier 25. The first interior closed weight carrier 25 has the same construction, structure, dimension as the first end closed weight carrier 24 excepting the commonality of the carriers' first 24*a*, 25*a* and second 24*b*, 25*b* ends.

The second interior permanently closed weight carrier 26 is adjacent the third interior permanently closed weight carrier 27 along the second interior closed weight carrier 26 second end 26*b* and third interior closed weight carrier 27 first end 27*a*. The third interior weight carrier first end 27*a* is common with the second interior closed weight carrier second end 26*b*. The first end 27*a* of the third interior closed weight carrier 27 and the second end 26*b* of the second interior closed weight carrier 26 have a common seam 26*b*', 27*a*' and stiches. The second interior weight carrier 26 is coupled to the third interior closed weight carrier 27. The second interior closed weight carrier 26 has the same construction, structure, dimension as the first interior closed weight carrier 27 excepting the commonality of the carriers' first 26*a*, 27*a* and second 26*b*, 27*b* ends.

The third interior permanently closed weight carrier 27 is adjacent the fourth interior permanently closed weight carrier 28 along the fourth interior weight carrier 28 first end 28*a* and third interior weight carrier 27 second end 27*b*. The third interior weight carrier second end 27*b* is common with the first end 28*a* of the fourth interior weight carrier 28. The second end 27*b* of the third interior weight carrier 27 and the first end 28*a* of the fourth interior closed weight carrier 28 have a common seam 27*b*', 28*a*' and stiches. The third interior weight carrier 27 is coupled to the fourth interior weight carrier 28. The third interior closed weight carrier 27 has the same construction, structure, and dimension as the second interior closed weight carrier 26 excepting the commonality of the carriers' first 27*a*, 28*a* and second 27*b*, 28*b* ends.

The fourth interior permanently closed weight carrier 28 is adjacent the fifth interior permanently closed weight carrier 29 along the fourth interior closed weight carrier 28 second end 28*b* and the fifth interior weight carrier 29 first end 29*a*. The second end 28*b* of the fourth interior weight carrier 28 is common with the first end 29*a* of the fifth interior permanently closed weight carrier 29. The first end 29*a* of the fifth interior weight carrier 29 and the second end 28*b* of the fourth interior weight carrier 28 have a common seam 28*b*', 29*a*' and stitches. The fourth interior weight carrier 28 is coupled to the fifth interior weight carrier 29. The fourth interior weight carrier 28 has the same construction, structure, and dimension as the third interior weight carrier 27 excepting the commonality of the carriers' first 27*a*, 28*a* and second 27*b*, 28*b* ends.

The fifth interior closed weight carrier 29 is adjacent the second end permanently closed weight carrier 30 along the fifth interior closed weight carrier 29 second end 29*b* and the second end weight carrier 30 first end 30*a*. The second end 29*b* of the fifth interior weight carrier 29 is common with the first end 30*a* of the second end closed interior weight carrier 30. The second end 29*b* of the fifth interior weight carrier 29 and the first end 30*a* of the second end interior weight carrier 30 have a common seam 29*b*', 30*a*' and stitching. The fifth interior weight carrier 29 is coupled to the second end closed weight carrier 30. The fifth interior weight carrier 29 has the same construction, structure, and dimension as the fourth interior weight carrier 28 excepting the commonality of the carriers' first 28*a*, 29*a* and second 28*b*, 29*b* ends.

The first end 30*a* of the second end permanently closed weight carrier 30 is common with a second end. Depending on how many carriers are present in a weight assembly, the second end can be the second end 26*b*, 27*b*, 28*b*, 29*b*, of an interior closed weight carrier, such as the second 26, third 27, fourth 28 or fifth 29 interior weight carrier. It can also be the second end 24*b* of the first end closed weight carrier 24. In the present example the commonality is with the second end 29*b* of the fifth interior closed weight carrier 29. The second end 30*b* of the second end permanently closed weight carrier 30 is not adjacent another weight carrier of the weight carrier assembly 22. The second end 30*b* is the end that is closest to the sock closed end 36 when the sock 20 is in an elongated orientation but in a relaxed, unstretched, state. The second end closed weight carrier 30 has the same type of construction, structure, and dimension as the first end closed weight carrier 24 excepting the commonality of the carriers' first 24*a*, 30*a* and second 24*b*, 30*b* ends.

In accordance with the above, each carrier 24, 25, 26, 27, 28, 29 30 has a first portion of material 24*e*, 25*e*, 26*e*, 27*e*, 28*e*, 29*e*, 30*e* joined to a second portion of material 24*f*, 25*f*, 26*f*, 27*f*, 28*f*, 29*f*, 30*f*. Each carrier of the weight assembly has a first end 24*a*, 25*a*, 26*a*, 27*a*, 28*a*, 29*a*, 30*a*. The first end is permanently closed. The first end of each carrier has a seam 24*a*', 25*a*', 26*a*', 27*a*', 28*a*', 29*a*', 30*a*' which comprises stitches joining the first portion of material 24*e*, 25*e*, 26*e*, 27*e*, 28*e*, 29*e*, 30*e* to the second portion of material 24*f*, 25*f*, 26*f*, 27, 28*f*, 29*f*, 30*f*. Each carrier has a second end 24*b*, 25*b*, 26*b*, 27*b*, 28*b*, 29*b*, 30*b* opposite the first end. The second end is permanently closed. The second end of each carrier has a seam 24*b*', 25*b*', 26*b*', 27*b*', 28*b*', 29*b*', 30*b*' which comprises stitches joining the first portion of material 24*e*, 25*e*, 26*e*, 27*e*, 28*e*, 29*e*, 30*e* to the second portion of material 24*f*, 25*f*, 26*f*, 27, 28*f*, 29*f*, 30*f*. Each carrier of the weight assembly 22 has a third end 24*c*, 25*c*, 26*c*, 27*c*, 28*c*, 29*c*, 30*c*. The third end is permanently closed. The third end of each carrier has a seam 24*c*', 25*c*', 26*c*', 27*c*', 28*c*', 29*c*', 30*c*' which comprises stitches joining the first portion of material 24*e*, 25*e*, 26*e*, 27*e*, 28*e*, 29*e*, 30*e* to the second portion of material 24*f*, 25*f*, 26*f*, 27, 28*f*, 29*f*, 30*f*. Each carrier has a fourth end 24*d*, 25*d*, 26*d*, 27*d*, 28*d*, 29*d*, 30*d* opposite the third end. The fourth end is permanently closed. The fourth end of each carrier has a seam 24*d*', 25*d*', 26*d*', 27*d*', 28*d*', 29*d*', 30*d*' which comprises stitches joining the first portion of material 24*e*, 25*e*, 26*e*, 27*e*, 28*e*, 29*e*, 30*e* to the second portion of material 24*f*, 25*f*, 26*f*, 27, 28*f*, 29*f*, 30*f*. The stitches of the weight carriers are called an elastic stitch A line intersecting both the third and fourth end of any carrier is perpendicular to a line intersecting the first and second end of that carrier. Each carrier is in the shape of a rectangle. Each carrier is permanently closed at all four sides of the rectangle moving from the interior of the carrier to the exterior. The carriers are all interconnected and arranged in a columnar orientation. The carriers are the same.

The first portion of material 24*e*, 25*e*, 26*e*, 27*e*, 28*e*, 29*e*, 30*e* of each weight carrier is elastomeric. The first portion of material is a fabric. The first portion of material is stretchable to expand in a first direction and a second direction. The second direction can be opposite the first direction. The first direction can be in the Z direction relative to a Z axis. The second direction can be in the −Z direction relative to the Z axis. The first direction can be in the Y direction relative to a Y axis. The second direction can be in the −Y direction relative to the Y axis. The second portion of material 24*f*, 25*f*, 26*f*, 27, 28*f*, 29*f*, 30*f* of each weight carrier can also be elastomeric and stretchable just like the first portion of material or in directions different from the first portion of material.

Each carrier 24, 25, 26, 27, 28, 29, 30 has an enclosed carrier space 38. Interior surfaces of the carrier delimit and define the carrier space 38. The first material portion 24*e*, 25*e*, 26*e*, 27*e*, 28*e*, 29*e*, 30*e* and second 24*f*, 25*f*, 26*f*, 27, 28*f*, 29*f*, 30*f* material portion of each carrier have the interior surfaces. These interior surfaces delimit and define the enclosed carrier space 38. Each carrier space 38 has a weight 40 therein. Each weight 40 in a carrier space 38 comprises a plurality of mass units 42. The plurality of individual mass units 42 in each weight carrier enclosed space 38 have the same mass, the same weight, the same shape, and the same dimension to each other. The mass units 42 can have similar mass, weight, shape, and dimension. Each category of similarity between the mass units 42 within a weight carrier 24, 25, 26, 27, 28, 29, 30 being within 70%. Each mass unit 42 is made of stainless steel. Each mass unit 42 in each of the weight carriers' enclosed space 38 is snugly held within the space by the first 24*e*, 25*e*, 26*e*, 27*e*, 28*e*, 29*e*, 30*e* and second 24*f*, 25*f*, 26*f*, 27, 28*f*, 29*f*, 30*f* portion of material of each respective weight carrier. A portion of material, and preferably both the first and second portions of material of each weight carrier, are in constant contact with each of their respective plurality of mass units 42 in the enclosed space 38 when the sock 20 is at rest and not in use and when the sock is in use by a wearer of the sock. Within each carrier enclosed space 38, each mass unit 42 in that carrier enclosed space is movable within a fixed range relative to each other mass unit 42 in that carrier enclosed space 38.

The following description of weight, mass units, carrier, and portion(s) of material applies to all the weights, mass units, carriers, and portions of material of the weight assembly. A single weight carrier and its respective weight, mass units, and first and second portions of material are sometimes described for conciseness and ease of description. The weight 40 and mass units 42 associated with each carrier 24, 25,26,27,28,29,30 are the same. The first 24*e*, 25*e*, 26*e*, 27*e*, 28*e*, 29*e*, 30*e* and second 24*f*, 25*f*, 26*f*, 27, 28*f*, 29*f*, 30*f* portions of material associated with each carrier are the same. The carrier spaces 38 associated with each carrier 24, 25, 26, 27, 28, 29, 30 are the same. The term same means essentially the same construction, shape and dimension.

Each of the plurality of mass units 42, when their associated carrier 24, 25, 26, 27, 28, 29, 30 or portion(s) of material 24*e*, 25*e*, 26*e*, 27*e*, 28*e*, 29*e*, 30*e*; 24*f*, 25*f*, 26*f*, 27, 28*f*, 29*f*, 30*f* are stretched to expand in a direction under a force, is moveable along with the carrier or portion(s) of material stretched. They are moveable from a position and in the direction of expansion. The mass units are moveable relative to the other mass units of the plurality, when the units are in the carrier space. The direction of expansion is, capable of being in at least in the Z and/or −Z direction relative to the Z axis. The direction of expansion can also be in the Y and/or −Y direction relative to the Y axis. When the force stretching the carrier 24, 25, 26, 27, 28, 29, 30 or portion(s) of material 24*e*, 25*e*, 26*e*, 27*e*, 28*e*, 29*e*, 30*e*; 24*f*, 25*f*, 26*f*, 27, 28*f*, 29*f*, 30*f* is removed from the carrier or portion(s) of material, an elastomeric force contracts the stretched carrier or portion(s) of the material in a direction opposite the direction of expansion, returning the carrier or portion(s) of material to a more relaxed state; the elastomeric force also moving the moved mass unit 42 in the direction of contraction.

Each weight 40, comprising the individual mass units 42, is configurable to take on a first shape or dimension under a force of change which also changes the shape or dimension of their respective carrier 24, 25, 26, 27, 28, 29, 30 or portion(s) of material 24*e*, 25*e*, 26*e*, 27*e*, 28*e*, 29*e*, 30*e*; 24*f*, 25*f*, 26*f*, 27, 28*f*, 29*f*, 30*f* from their shape or dimension when not under the force. The changed shape or dimension of the carrier or portion(s) of material has a stored force of sufficient magnitude to return the carrier or portion(s) of material towards their first shape or dimension when not under the force of change. The force of sufficient magnitude also reconfigures the weight 40 into a second shape different from the first shape as the carrier 24, 25, 26, 27, 28, 29, 30 or portion(s) of material 24*e*, 25*e*, 26*e*, 27*e*, 28*e*, 29*e*, 30*e*; 24*f*, 25*f*, 26*f*, 27, 28*f*, 29*f*, 30*f* return towards their shape when not under the force of change. The second shape being a shape of the weight when not under change or at least more like the shape of the weight when not under the force of change. The stored force of sufficient magnitude in one example is an elastomeric force. The changed shape or dimension of the carrier or portion(s) of material includes an expanded portion caused by a stretching of an elastomeric portion of the carrier or portion(s) of material. Accordingly, the weight 40 can take on a first shape when the carrier 24, 25, 26, 27, 28, 29, 30 or portion(s) of material 24*e*, 25*e*, 26*e*, 27*e*, 28*e*, 29*e*, 30*e*; 24*f*, 25*f*, 26*f*, 27, 28*f*, 29*f*, 30*f* are stretched. The stretched carrier or portion(s) of material have an elastomeric force of sufficient magnitude to reconfigure the weight 40, comprising the individual mass units, from the first shape or dimension into a second shape or dimension when the carrier or portion(s) of material is not under the force stretching the carrier or portion(s) of material. The first shape or dimension can be a curved shape curving at least partially about a line extending in the Z, and/or −Z directions. The second shape or dimension can be a less curved, more flat shape. The second shape is more like the shape of the weight when not under the force stretching. The first shape or dimension can have a twist. The twist can be relative to and at least partially about a line extending in the X and/or −X direction relative the X axis. The second shape or dimension can be less twisted, flatter, than the first shape.

Each mass unit 42 of the plurality may be moved within its respective carrier space 38 to displace each other mass unit of the plurality in that carrier space 38. Thus, mass unit 42*a* may be moved to take the position of mass unit 42*b* and vice versa. Each mass unit 42 has a width measured in the Y or −Y direction of less than 0.5 inches. Each is preferably less than 0.3 inches. The width can be less than 0.2 inches. The width can be less than 0.3 inches. In the present case the width is about 0.125 inches. In the present case each mass unit 42 is cylindrical, and the width is a diameter. Each mass unit 42 has a length in the direction of the Z and/or −Z direction of less 1 inch. It is less than 0.75 inches. The length is more than 0.3 inches. The length is about 0.5 inches. The length is the height of the cylinder. Each mass unit has a weight of about 3.25 grams. It is more than 1 gram, more than 2 grams, and more than 3 grams and less than 5 grams and even less than 4 grams. There are at least two mass units 42 in the mass units' respective carrier space 38. There are more than three and even preferably more than four. In the present case, there are five mass units 42 in each carrier space 38. There are of course less than ten units and even less than seven units. The mass units 42 in each carrier 24, 25, 26, 27, 28, 29, 30 are arranged to align along a line extending from the third end 24*c*, 25*c*, 26*c*, 27*c*, 28*c*, 29*c*, 30*c* to the fourth end 24*d*, 25*d*, 26*d*, 27*d*, 28*d*, 29*d*, 30*d* of their respective carrier. The units form a row of units in each carrier space 38.

The thickness of the first portion of material of each carrier is about 1/32 inches. It is more than 1/40 inches and less than 1/15 inches. The thickness of the second portion of material of each carrier is the same as the first portion.

The thickness of the carrier and its associated mass in the Y and/or −Y direction is less than 0.5 inches. It is less than 0.4 inches. The thickness is more than 0.1 inch. It is more than 0.3 and less than 0.2 inches. It is about 0.19 inches. Each carrier 24, 25, 26, 27, 28, 29, 30 has a length along a line extending from the first end 24*a*, 25*a*, 26*a*, 27*a*, 28*a*, 29*a*, 30*a* to the second end 24*a*, 25*b*, 26*b*, 27*b*, 28*b*, 29*b*, 30*b* of more than 0.5 inches and less than 0.7 inches. The length is preferably 0.625 inches. The length is along the minor axis of the carrier. The carrier has a length along a line extending from the third end 24*c*, 25*c*, 26*c*, 27*c*, 28*c*, 29*c*, 30*c* to the fourth end 24*d*, 25*d*, 26*d*, 27*d*, 28*d*, 29*d*, 30*d* of more than 1.5 inches and less than 2 inches. The length is preferably 1.7 inches. The length is along the major axis of the carrier. All the first portions of material 24*e*, 25*e*, 26*e*, 27*e*, 28*e*, 29*e*, 30*e* of the carriers may be formed together from a single continuous and seamless piece of material which is a fabric. The fabric has a thickness of less than 1/15 of an inch. It is more than 1/40 of an inch. It is about 1/32 of an inch. All the second portions of material 24*f*, 25*f*, 26*f*, 27*f*, 28*f*, 29*f*, 30*f* of the carriers may be formed together from a single continuous and seamless piece material which is a fabric. The fabric has a thickness of more than 1/40 of an inch. It is less than 1/15 of an inch. It is 1/32 of an inch. Adjacent each carriers' third end is a border 44. The border 44 is outside the carrier space 38 and comprises a first material overlapping a second material. The first material is coupled to the first portion of material and extends from and is part of its respective first portion of material 24*e*; 25*e*; 26*e*;27*e*; 28*e*; 29*e*; 30*e*. The second material is coupled to the second portion of material and extends from and is part of its respective second portion of material 24*f*; 25*f*; 26*f*; 27*f*; 28*f*; 29*f*; 30*f*. Adjacent each carriers' fourth end is a border 46. The border is outside the carrier space 38 and comprises a first material overlapping a second material. The first material is coupled to the first portion of material and extends from and is part of the first portion of material 24*e*; 25*e*; 26*e*; 27*e*; 28*e*; 29*e*; 30*e*. The second material is coupled to the second portion of material and extends from and is part of the second portion of material 24*f*; 25*f*; 26*f*; 27*f*; 28*f*; 29*f*; 30*f*. The length of the weight assembly from border 44 to 46 is about 2 inches. Adjacent the first end carriers' 24 first end 24*a* is a border 48 outside the carrier space 38 which comprises a first material overlapping a second material. The first material is coupled to the first portion of material 24*e* and extends from and is part of the first portion of material 24*e*. The second material is coupled to the second portion of material 24*f* and extends from and is part of the second portion of material 24*f*. Adjacent the second end weight carrier 30 second end 30*b* is a border 50 outside the carrier space 38 which comprises a first material overlapping a second material. The first material is coupled to the first portion of material and extends from and is part of the first portion of material 30*e*. The second material is coupled to the second portion of material and extends from and is part of the second portion of material 30*f*. The length of the weight assembly from border 48 to border 50 is about 5.5 inches.

The weight assembly 22 is disposed between an exterior material 52 of the sock leg 20*a* and an interior material 54 of the sock leg 20*a*. The sock leg has the open end 34. The open end is distal the sock foot 20*b*. The weight assembly 22 is coupled to the interior material 54 by stitches going through the border 48 at the first end 24*a* of the first end weight carrier 24 and the border 50 at the second end 30*b* of the second end weight carrier 30. A second 222 and third 322 weight assembly are disposed between the exterior material 52 and interior material 54 of the sock leg 20*a*. The second 222 and third 322 weight assemblies are the same as the first weight assembly 22. Each weight assembly has the same construction, shape, and dimension. Each weight assembly, measured along a circumferential direction about the leg 20*a* of the sock, extends for more than 0.25 and less than 0.5 of the circumference of the leg 20*a* of the sock. Preferably each weight assembly extends 0.33 of the circumference of the sock leg 20*a* when the sock leg is at rest. Each weight assembly has a border 44 or 46 spaced from, in the circumferential direction, an adjacent border 44 or 46 of an adjacent weight assembly. The spacing between adjacent borders 44, 46 of adjacent weight assemblies is the same for all adjacent borders.

Having the weight assemblies 22, 222, 322 between the exterior material 52 and interior material 54 of the sock leg 20*a* helps conceal the weight assemblies; giving the sock an ordinary appearance. Having a sock with a more ordinary appearance helps remove the stigma of having a therapeutic sock. It is also believed having interior material 54 shrouding the weight assemblies 22, 222, 322 improves comfort. Notably, the spacing between adjacent borders of adjacent weight carriers is equidistant. Of course, to save material, the interior material 54 of the sock 20 could be made up of the second portions of material of the weight assemblies, for example made of second portions 24*f*, 25*f*, 26*f*, 27*f*, 28*f*, 29*f*, 30*f* of weight assembly 22. The exterior material 52 could still shroud the first portions of material of the weight assemblies, for example portions 24*e*, 25*e*, 26*e*, 27*e*, 28*e*, 29*e*, 30*e* of weight assembly 22. Alternatively, the exterior material 52 could form the first portions of material of the weight assemblies, for example portions 24*e*, 25*e*, 26*e*, 27*e*, 28*e*, 29*e*, 30*e* of the weight assembly 22. The interior material 54 could shroud the weight assemblies. As opposed to having a weight assembly 22, 222, 322 disposed between the exterior 52 and interior materials 54 of the sock leg 20*a*, the exterior 52 and interior 54 sock material of the sock leg 20*a* could form the weight carriers of the weight assemblies. In this case stitching would join the exterior material 52 to the interior material 54 to form the seams of the carriers at the carriers' first end, second end, third end, and fourth end. Weight assemblies 222 and 322 follow the same nomenclature as weight assembly 22 except a 222 precedes reference numbers for assembly 222. Thus, the first end carrier is labeled 22224. Thus, the first carrier of assembly 322 is labeled 32224. The sock leg 20*a* or leg of the sock 20*a* refers to the portion of the sock that receives the leg of a user and terminates at the users' ankle. The closed end 36 of the sock is at the toe portion 20*c* of the sock 20. The toe portion 20*c* of the sock is the portion of the sock that receives the toes. The heel portion 20*d* of the sock is the portion of the sock that receives the heel. The heel portion is closed. The foot portion 20*b* of the sock is the portion of the sock that receives the foot of the sock. The foot 20*b* of the sock has the toe portion 20*c* and heel portion 20*d*. Both the heel and toe are closed.

A second weighted sock, the same as the first weighted sock, is provided to provide pairs of weighted socks where each sock is the same.

As is evident from the foregoing description, certain aspects of the present invention are not limited to the details of the examples illustrated herein. It is therefore contemplated that other modifications and applications using other similar or related features or techniques will occur to those skilled in the art. It is accordingly intended that all such modifications, variations, and other uses and applications which do not depart from the spirit and scope of the present invention are deemed to be covered by the present invention.

Other aspects, objects, and advantages of the present invention can be obtained from a study of the drawings, the disclosures, and the appended claims.

The invention claimed is:

1. A weighted sock, said weighted sock has a sock leg and a sock foot, the sock leg has an open end distal to the sock foot, the sock foot has a closed end distal to the open end, the closed end is at a toe portion of the sock, a weight assembly of the weighted sock is at a portion of the sock, the weight assembly has a weight carrier, said weight carrier has a carrier space, said weighted sock further comprising:

a weight in the carrier space, said weight comprises a plurality of individual mass units, wherein;

the weight is configurable to take on a first shape or dimension by a force which also changes the shape or dimension of the weight carrier, the carrier when having the changed shape or dimension has a force of sufficient magnitude to reconfigure the weight into a second shape or dimension different from the first shape when the force which also changes the shape or dimension of the carrier is removed.

2. The weighted sock of claim 1 wherein the force of sufficient magnitude is an elastic force.

3. The weighted sock of claim 2 wherein the weight carrier comprises:

a first portion of material coupled to a second portion of material, wherein said carrier space is delimited by the first portion of material and second portion of material, and wherein;

the first portion of material is elastomeric.

4. The weighted sock of claim 3 wherein the second portion of material is elastomeric.

5. The weighted sock of claim 4 wherein each mass unit of the plurality is in the carrier space and is movable within a fixed range relative to each other mass unit of the plurality in the carrier space.

6. The weighted sock of claim 5 wherein, any of the plurality of mass units, when the first and second portions of material are stretched to expand in a direction under the force which changes the shape or dimension of the carrier, is moveable relative to each other of the plurality of mass units along with the first and second portions of material stretched in the direction of expansion to form the first shape, and when the force stretching the portions of material is removed from the carrier, the elastic force contracts the stretched portions of the material in a direction opposite the direction of expansion, returning the portions of material to a more relaxed state; the elastomeric force also moving the moved mass unit in the direction of contraction to form the second shape.

7. The weighted sock of claim 6 wherein the carrier space is enclosed.

8. The weighted sock of claim 7 wherein the carrier space is continuous.

9. The weighted sock of claim 6 wherein there are a plurality of the weight carriers each having individual mass units, the weight assembly comprises the plurality of weight carriers.

10. The weighted sock of claim 9 wherein the plurality of weight carriers is coupled to each other and arranged in a columnar orientation.

11. The weighted sock of claim 10 wherein one of the plurality of weight carriers is a first end weight carrier and another of the plurality is a second end weight carrier, the first end weight carrier is closest to the sock open end as compared to all other weight carriers of the plurality of weight carriers, the second end weight carrier is closest to the sock closed end as compared to all other weight carriers of the plurality when the sock is in an elongated orientation but in a relaxed, unstretched, state.

12. The weighted sock of claim 3 wherein a seam couples the first portion of material to the second portion of material.

13. The weighted sock of claim 12 wherein the seam comprises stitches.

14. The weighted sock of claim 2, wherein the first shape is a curved shape curving at least partially about a line extending in the Z, and/or −Z direction and the second shape is a less curved, more flat shape.

15. The weighted sock of claim 2 wherein the first shape has a twist which twists at least partially about a line extending in the X and/or −X direction and the second shape is less twisted, flatter, than the first shape.

16. The weighted sock of claim 1 wherein the weight assembly is shrouded by an exterior material of the weighted sock.

17. The weighted sock of claim 16 wherein the weight assembly is between the exterior material of the weighted sock and an interior material of the weighted sock.

18. The weighted sock of claim 1 wherein the first portion of material and second portion of material are formed from an interior material and exterior material of the sock.

19. A weighted sock, said weighted sock has a sock leg and a sock foot, the sock leg has an open end distal to the sock foot, the sock foot has a closed end distal to the open end, the closed end is at a toe portion of the sock, a weight assembly of the weighted sock is at a portion of the sock, the weight assembly has a weight carrier, said weight carrier has a carrier space, said weighted sock further comprising:

a weight in the carrier space, said weight comprises a plurality of individual mass units, wherein;

the weight is configurable to take on a first shape by a force caused by wearing the weighted sock, said force of wearing also changes the shape or dimension of the weight carrier, the weight reconfigures into a second shape different from the first shape when the force caused by wearing the sock is removed.

20. The weighted sock of claim 19 wherein each mass unit is substantially cylindrical with a height of 0.5 inches and a diameter of less than 0.4 inches, there are 5 mass units arranged in a row in each weight carrier, each mass unit is stainless steel, said weight carrier comprises elastic stitches coupling a first portion of material to a second portion of material.

* * * * *